US008866713B2

(12) United States Patent
Lee et al.

(10) Patent No.: US 8,866,713 B2
(45) Date of Patent: Oct. 21, 2014

(54) LIQUID CRYSTAL DISPLAY DEVICE

(75) Inventors: Dong-Hoon Lee, Gyeonggi-Do (KR); Ho-Jin Ryu, Gyeonggi-Do (KR)

(73) Assignee: LG Display Co., Ltd., Seoul (KR)

( * ) Notice: Subject to any disclaimer, the term of this patent is extended or adjusted under 35 U.S.C. 154(b) by 2147 days.

(21) Appl. No.: 11/148,373

(22) Filed: Jun. 9, 2005

(65) Prior Publication Data

US 2006/0145983 A1 Jul. 6, 2006

(30) Foreign Application Priority Data

Dec. 31, 2004 (KR) ..... 10-2004-0118371

(51) Int. Cl.
*G09G 3/36* (2006.01)

(52) U.S. Cl.
CPC ..... *G09G 3/3648* (2013.01); *G09G 2320/0209* (2013.01); *G09G 2300/0426* (2013.01); *G09G 2300/0434* (2013.01); *G09G 3/3614* (2013.01); *G09G 2330/021* (2013.01); *G09G 3/3655* (2013.01)
USPC ..... 345/92

(58) Field of Classification Search
USPC ..... 345/30, 55, 84, 87, 88, 89, 90, 91, 92, 345/93, 94, 95, 96, 97, 98, 99, 100, 101, 345/102, 103, 104, 204, 205, 206, 208, 209, 345/210, 214, 690, 691; 349/33, 34, 36, 37, 349/38, 39, 41, 42, 46, 47, 48, 54
See application file for complete search history.

(56) References Cited

U.S. PATENT DOCUMENTS

| | | | | |
|---|---|---|---|---|
| 6,292,237 | B1 * | 9/2001 | Hebiguchi | 349/39 |
| 6,407,728 | B1 * | 6/2002 | Sekine | 345/90 |
| 6,421,039 | B1 * | 7/2002 | Moon et al. | 345/100 |
| 6,522,370 | B2 * | 2/2003 | Takahashi et al. | 349/43 |
| 6,583,829 | B2 * | 6/2003 | Ootsu et al. | 349/43 |
| 6,646,691 | B1 * | 11/2003 | Watanabe et al. | 349/39 |
| 6,646,692 | B2 * | 11/2003 | Yamazaki et al. | 349/47 |
| 6,686,986 | B2 * | 2/2004 | Niwano et al. | 349/143 |
| 6,707,512 | B2 * | 3/2004 | Takahashi et al. | 349/43 |
| 6,806,935 | B2 * | 10/2004 | Song | 349/141 |
| 6,864,939 | B2 * | 3/2005 | Niwano et al. | 349/141 |
| 6,950,168 | B2 * | 9/2005 | Yamazaki et al. | 349/141 |
| 6,963,335 | B2 * | 11/2005 | Tanaka et al. | 345/204 |
| 7,038,747 | B2 * | 5/2006 | Lee et al. | 349/106 |
| 7,042,430 | B2 * | 5/2006 | Isami et al. | 345/89 |
| 7,133,015 | B1 * | 11/2006 | Yoshida et al. | 345/99 |
| 7,209,103 | B2 * | 4/2007 | Maeda et al. | 345/87 |
| 7,295,275 | B2 * | 11/2007 | Ko | 349/141 |

(Continued)

*Primary Examiner* — Kent Chang
*Assistant Examiner* — Scott Au
(74) *Attorney, Agent, or Firm* — McKenna Long & Aldridge LLP

(57) ABSTRACT

A liquid crystal display (LCD) device capable of reducing the driving power and preventing cross talk is provided. The LCD device comprises: a plurality of data lines arranged on a substrate in a vertical direction for transmitting image data; a plurality of gate lines arranged on the substrate in a horizontal direction for transmitting a scan signal; a plurality of pixels formed at each intersection between the gate lines and the data lines and arranged on the substrate in a matrix formation; a first electrode and a second electrode respectively provided at each pixel for forming a horizontal electric field; and a plurality of first common voltage lines and second common voltage lines alternately arranged on the substrate in a horizontal direction, wherein the second electrodes provided at each pixel of a line unit are alternately connected to the first common voltage line and the second common voltage line.

6 Claims, 8 Drawing Sheets

(56) References Cited

U.S. PATENT DOCUMENTS

| | | | | |
|---|---|---|---|---|
| 7,319,448 | B2 * | 1/2008 | Kim et al. | 345/87 |
| 7,362,401 | B2 * | 4/2008 | Niwano et al. | 349/141 |
| 2001/0019372 | A1 * | 9/2001 | Ootsu et al. | 349/38 |
| 2003/0025661 | A1 * | 2/2003 | Karman et al. | 345/87 |
| 2003/0156086 | A1 * | 8/2003 | Maeda et al. | 345/89 |
| 2003/0169379 | A1 * | 9/2003 | Tsumura et al. | 349/42 |
| 2004/0004595 | A1 * | 1/2004 | Isami et al. | 345/89 |
| 2004/0041773 | A1 * | 3/2004 | Takeda et al. | 345/98 |
| 2004/0085278 | A1 * | 5/2004 | Chae et al. | 345/90 |
| 2004/0085503 | A1 * | 5/2004 | Kim et al. | 349/141 |
| 2004/0125057 | A1 * | 7/2004 | Moon et al. | 345/87 |
| 2004/0263743 | A1 * | 12/2004 | Kim et al. | 349/139 |
| 2005/0139837 | A1 * | 6/2005 | Lee et al. | 257/72 |
| 2006/0012729 | A1 * | 1/2006 | Tanaka et al. | 349/54 |

* cited by examiner

LIQUID CRYSTAL DISPLAY DEVICE

This application claims the benefit of Korean Patent Application No. 118371, filed on Dec. 31, 2004, which is hereby incorporated by reference for all purposes as if fully set forth herein.

BACKGROUND OF THE INVENTION

1. Field of the Invention

The present invention relates to a liquid crystal display (LCD) device, and more particularly, to an LCD device of an inversion method capable of lowering power consumption and preventing deteriorated picture quality.

2. Description of the Conventional Art

LCD devices are widely used as the next generation display devices, replacing conventional cathode ray tubes (CRT) because of the advantages of LCD devices, such as a high picture quality, a low power consumption, a light weight, and the like.

LCD devices use the optical anisotropy of liquid crystals to display an image by controlling the transmittance of light supplied from a light source. The transmittance of the light is controlled by applying an electric field to liquid crystals contained between a thin film transistor array substrate and a color filter substrate, thereby rearranging the liquid crystals.

Generally, LCD devices are manufactured using twisted nematic (TN) liquid crystals. The TN liquid crystal is driven by a vertical electric field of a common electrode formed on the thin film transistor array substrate and a common electrode formed on the color filter substrate. However, the light transmittance of the TN liquid crystal changes according to the viewing angle in right and left directions which limites the fabrication of large area LCD devices.

That is, in a TN LCD device driven by a vertical electric field, the light transmittance is symmetrically distributed according to a viewing angle in right and left directions but is asymmetrically distributed according to a viewing angle in up and down directions. Accordingly, image inversion is generated in up and down directions thereby narrowing the viewing angle.

In order to solve this problem, an in-plane switching (IPS) method for driving the liquid crystal using a horizontal electric field has been proposed.

The IPS LCD device enhances viewing angle characteristics such as contrast, gray inversion, and color shift, as compared to an LCD device where the liquid crystal is driven using a vertical electric field. Therefore, the IPS LCD device obtains a wider viewing angle. Accordingly, the IPS method is widely used in LCD devices with a large display area.

FIG. 1 is an exemplary view illustrating a planar construction of a thin film transistor array substrate in a general IPS LCD device. As illustrated in FIG. 1, the LCD device comprises: a plurality of gate lines GL1~GLn arranged on a substrate in a horizontal direction; a plurality of common voltage lines CL1~CLn arranged to be alternate with the gate lines GL1~GLn on the substrate in a horizontal direction; a plurality of data lines DL1~DLm arranged on the substrate in a vertical direction, perpendicular to the gate lines GL1~GLn; and a plurality of pixels P1 formed at each intersection between the gate lines GL1~GLn and the data lines DL1~DLm. Each pixel P1 is provided with a pixel electrode 11 and a thin film transistor T1. The thin film transistor is generally used as the switching device.

As illustrated, the source electrode of the thin film transistor T1 is connected to the data lines DL1~DLm, the gate electrode is connected to the gate lines GL1~GLn, and the drain electrode is connected to the pixel electrode 11.

The pixel P1 is provided with not only the pixel electrode 11 but also a common electrode 13. The common electrode 13 is electrically connected to the common voltage lines CL1~CLn, and is arranged in the pixel P1 to be alternate and in parallel with the pixel electrode 11.

In the IPS LCD device, when a scan signal is sequentially applied to the gate lines GL1~GLn from a gate driving unit (not shown), the thin film transistors T1 of which gate electrodes are connected to corresponding gate lines GL1~GLn are turned on by the potential of the scan signal. Also, image data outputted from a data driving unit (not shown) is applied to the pixel electrode 11 through the source electrode of the thin film transistor T1.

A common voltage is applied to the common electrode 13 through the common voltage lines CL1~CLn, so that a voltage difference is generated between the pixel electrode 11 and the common electrode 13 arranged in parallel with each other. The voltage difference generates a horizontal electric field thereby re-arranging the liquid crystal inside the pixel P1. The arrangement of the liquid crystal changes according to the size of the electric field thereby varying the transmittance of the light supplied from a lamp. Since the common voltage lines CL1~CLn are electrically connected to each another, the same voltage is applied to each common electrode 13 through the common voltage lines CL1~CLn.

As aforementioned, since the scan signal outputted from the gate driving unit is sequentially applied to each gate line GL1~GLn for one frame, the pixels P1 corresponding to each gate line GL1~GLn to which the scan signal is not applied have to maintain the arrangement of liquid crystal for one frame thereby to maintain a certain brightness. The common electrode 13 and the pixel electrode 11 are separated from each other with liquid crystal there between and serve as a capacitor. Hereinafter, the common electrode 13 and the pixel electrode 11 will be called as a liquid crystal capacitor. Since a charge is filled between the common electrode 13 and the pixel electrode 11 as much as a voltage difference between a common voltage and a voltage according to the image data, the arrangement of the liquid crystal is maintained for one frame. Also, the common electrode 13 formed at the pixel P1 is overlapped with the previous gate lines GL1~GLn at a certain region thereby to serve as a capacitor and is called as a storage capacitor. The storage capacitor complements a charged capacity of the liquid crystal capacitor.

When a certain electric field is constantly applied to a liquid crystal layer of the LCD device, liquid crystal deteriorates and an afterimage is caused by a direct current voltage component. In order to prevent the liquid crystal from deteriorating and to remove the direct current voltage component, a voltage of image data is applied to the liquid crystal layer to repeat a positive voltage and a negative voltage on the basis of the common voltage, which is called as an inversion method.

The inversion driving method includes a frame inversion method that supplies the polarity of the image data to the liquid crystal layer by inverting at each frame; a line inversion method that supplies the polarity of the image data to the liquid crystal layer by inverting at each gate line; and a dot inversion method that supplies the polarity of the image data to the liquid crystal layer by inverting adjacent pixels and at each image frame.

The dot inversion method decreases screen distortion such as a flicker or a cross talk, therefore it the dot inversion method is generally used to fabricate an LCD device.

FIG. 2 is an exemplary view illustrating a voltage waveform of a pixel in according to the dot inversion method. As illustrated in FIG. 2, a common voltage Vcom is sustained as a direct current voltage at a certain level, and scan signals Vgate1~Vgate3 are sequentially applied to gate lines during each frame.

Image data Vdata is applied to adjacent pixels by inverting the data into a positive voltage and a negative voltage based on the common voltage Vcom. In addition, the image data is applied at consecutive frame units by inverted into a positive voltage and a negative voltage based on the common voltage Vcom.

The image data Vdata applied to the pixel electrode during a turn-on period of the thin film transistor, to which the scan signals Vgate1~Vgate3 are applied as a high potential, is shown as a waveform of a pixel voltage Vp. The image data Vdata is charged in the pixel, up to a desired level, while the scan signals Vgate1~Vgate3 of a high potential are applied to the thin film transistor.

When the scan signals Vgate1~Vgate3 are changed into a low potential, the gate electrode and the drain electrode of the thin film transistor overlap thereby generating a a parasitic capacitance. As a result, the image voltage Vp is lowered, this is referred to as the varied component ΔVp of a pixel voltage. The voltage lowering of the pixel voltage is equally generated at a positive voltage and a negative voltage.

The liquid crystal is driven during a turn-off period of the thin film transistor during which the scan signals Vgate1~Vgate3 are applied as a low potential by the voltage charged in the pixel.

The voltage obtained by subtracting the common voltage Vcom from the pixel voltage Vp is defined as the liquid crystal driving voltage Vcel (Vdata-Vcom). The arrangement of liquid crystal becomes different according to the size of the liquid crystal driving voltage Vcel. Since the common voltage Vcom is applied to the LCD device as a constant voltage at a certain level, the voltage level of the image data Vdata has to be changed in order to change the liquid crystal driving voltage Vcel. That is, the image data Vdata having a voltage more than the common voltage Vcom has to be applied to the LCD device, and the image data Vdata has to be swung as a positive voltage and a negative voltage based on the common voltage Vcom, thereby increasing consumption power of the LCD device.

SUMMARY OF THE INVENTION

Accordingly, the present invention is directed to a liquid crystal display device that substantially obviates one or more of the problems due to limitations and disadvantages of the related art.

An advantage of the present invention is to provide an LCD device capable of preventing deterioration in picture quality caused by horizontal cross talk by implementing a dot inversion method capable of increasing the voltage difference between a pixel electrode and a common electrode by applying a common voltage swung in different directions at adjacent pixels and image data having a polarity different from that of the common voltage.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, there is provided an LCD device comprising a plurality of data lines arranged on a substrate in a first direction; a plurality of gate lines arranged on the substrate in a second direction; a plurality of pixels formed at each intersection between the gate lines and the data lines and arranged on the substrate in a matrix configuration; a first electrode and a second electrode respectively provided at each pixel for forming a horizontal electric field there between; and a plurality of first common voltage lines and a plurality of second common voltage lines alternately arranged on the substrate in the second direction, wherein the second electrodes provided at each pixel in a line unit are alternately connected to the first common voltage line and the second common voltage line.

In another aspect of the present invention, the LCD device comprises: a plurality of data lines arranged on a substrate in a first direction for transmitting image data; a plurality of gate lines arranged on the substrate in a second direction to cross the data lines; a plurality of pixels formed at each intersection between the gate lines and the data lines and arranged on the substrate in a matrix configuration; a first electrode and a second electrode respectively provided at each pixel for forming a horizontal electric field there between; and a plurality of first common voltage lines and a plurality of second common voltage lines alternately arranged on the substrate in a first direction, wherein the second electrodes provided at pixels in a column unit are alternately connected to the first common voltage line and the second common voltage line.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to embodiments of the present invention, examples of which are illustrated in the accompanying drawings.

An LCD device according to an exemplary embodiment of the present invention comprises: a plurality of data lines arranged on a substrate in a vertical direction for transmitting image data; a plurality of gate lines arranged on the substrate in a horizontal direction for transmitting a scan signal; a plurality of pixels formed at each intersection between the gate lines and the data lines and arranged on the substrate in a matrix form; a first electrode and a second electrode respectively provided at each pixel for forming a horizontal electric field; and a plurality of first common voltage lines and second common voltage lines horizontally arranged on the substrate such that they alternate with each other, wherein the second electrode provided at each pixel in a line unit is alternately connected to the first common voltage line and the second common voltage line.

According to another aspect of the present invention, the LCD device comprises: a plurality of data lines arranged on a substrate in a vertical direction for transmitting image data; a plurality of gate lines arranged on the substrate in a horizontal direction for transmitting a scan signal; a plurality of pixels formed at each intersection between the gate lines and the data lines and arranged on the substrate in a matrix form; a first electrode and a second electrode respectively provided at each pixel for forming a horizontal electric field; and a plurality of first common voltage lines and second common voltage lines arranged on the substrate in a vertical direction such that they alternate with each other, wherein the second electrode provided at each pixel in a column unit alternately connected to the first common voltage line and the second common voltage line.

Figure 1:
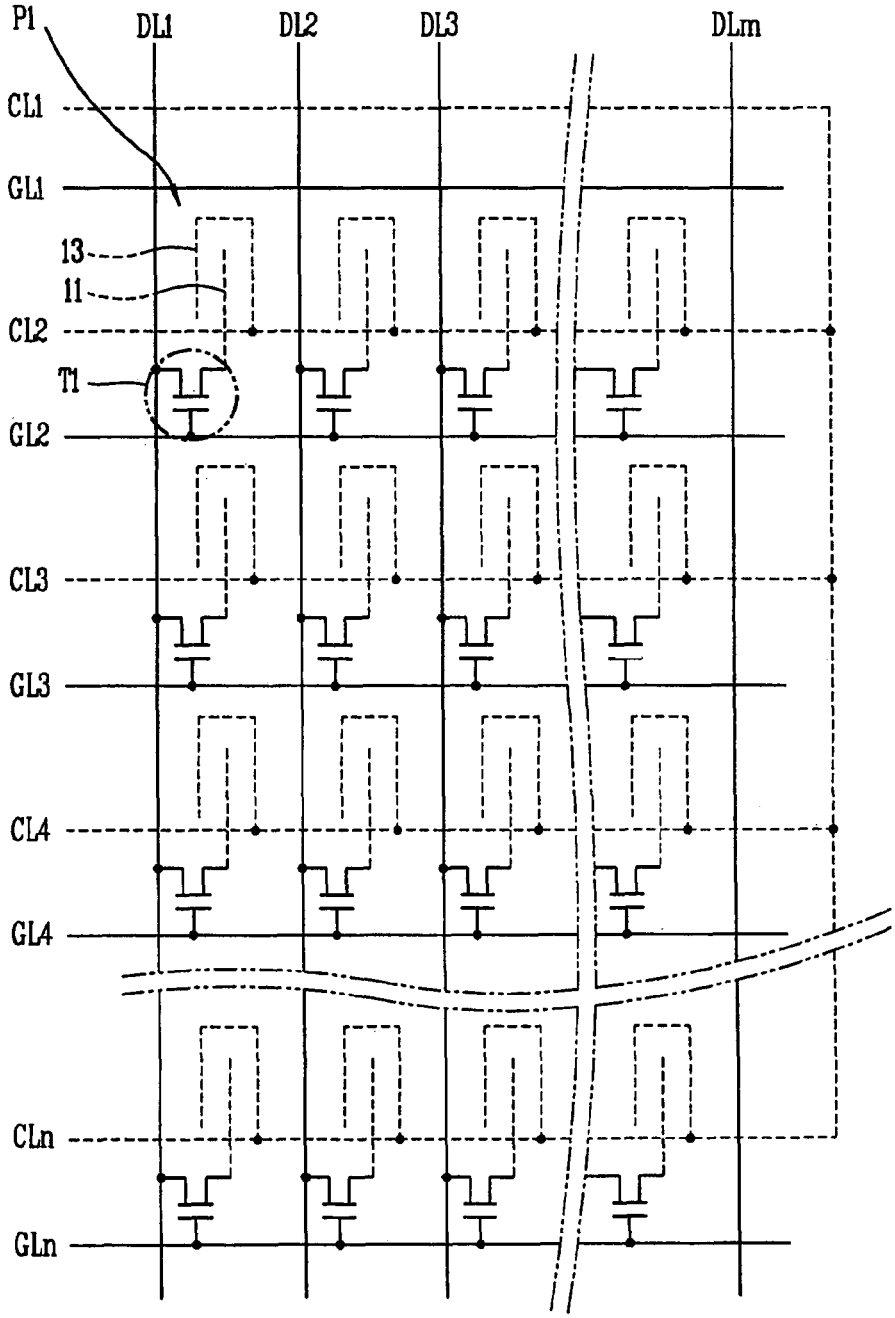
FIG. 1 RELATED ART
FIG. 1 is an exemplary view illustrating a planar construction of a thin film transistor array substrate in a related art IPS LCD device.
Figure 2:
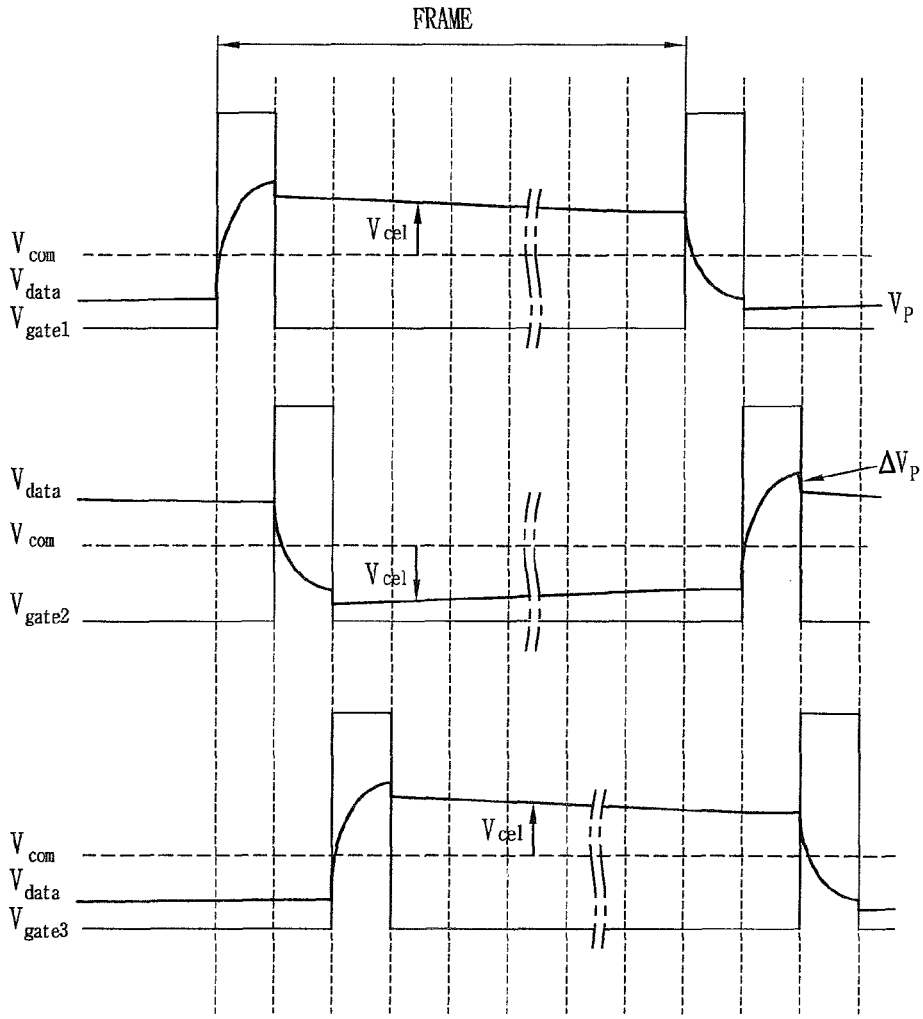
FIG. 2 RELATED ART
FIG. 2 is an exemplary view illustrating a voltage waveform of a pixel in a related art dot inversion method.
Figure 3:
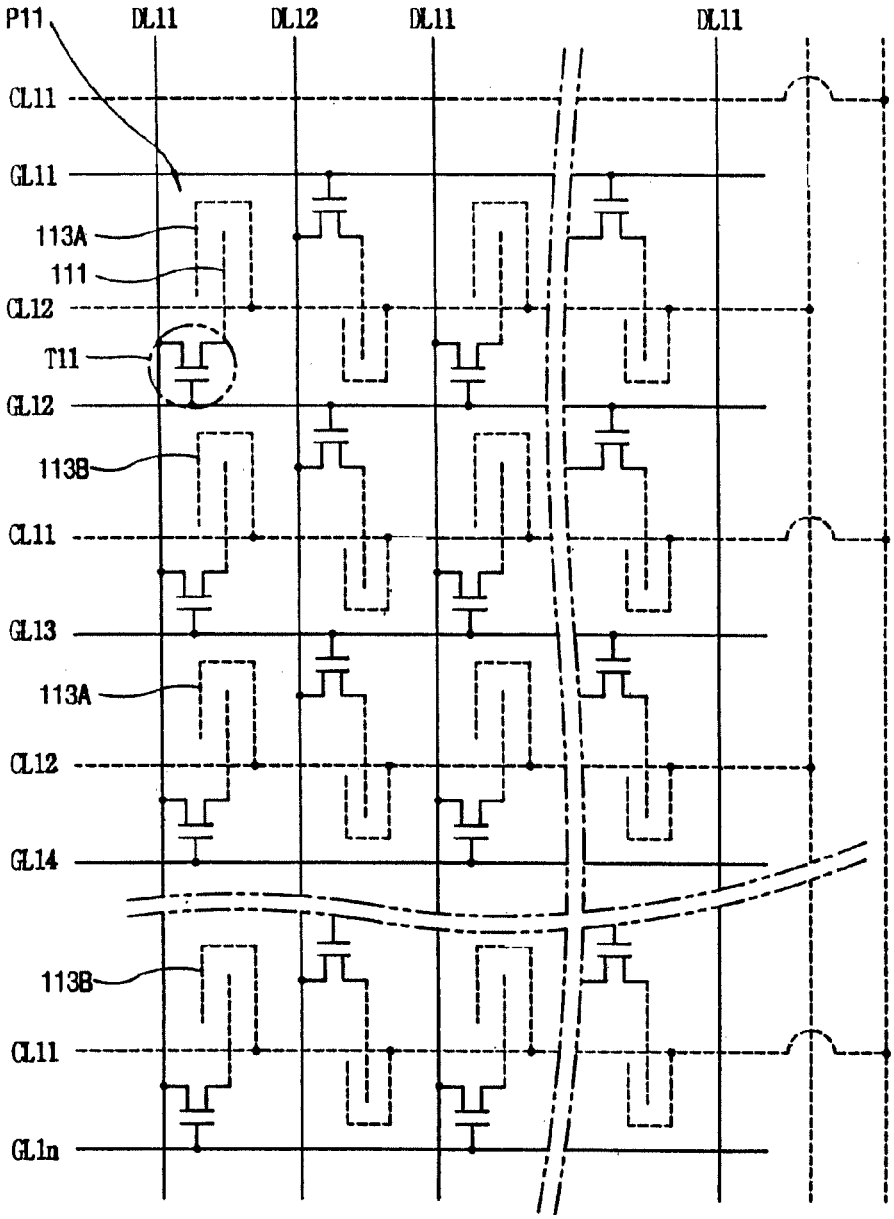
FIG. 3 is a view illustrating a planar construction of an IPS LCD device according to a first embodiment of the invention.

FIG. 3 is a view illustrating a planar construction of an IPS LCD device according to a first embodiment of the present invention. As shown in FIG. 3, the LCD device comprises: a plurality of gate lines GL11~GL1*n* arranged on a substrate in a horizontal direction; a plurality of first data lines DL11 and second data lines DL12 arranged on the substrate in a vertical direction such that they alternate with each other; a plurality of first and second common voltage lines CL11 and CL12 arranged on the substrate in a horizontal direction such they alternate with the gate lines GL11~GL1*n*; a plurality of pixels P11 formed at each intersection between the gate lines GL11~GL1*n* and the data lines DL11 and DL12; a pixel electrode 111; and common electrodes 113A and 113B provided in the pixel P11 and forming a horizontal electric field. The plurality of pixels P11 arranged on the substrate in a matrix configuration such that they are divided into a plurality of lines and columns.

Each pixel P11 is provided with a switching device, for example, a thin film transistor T11, for applying image data applied to the pixel electrode 111 to the pixel.

The source electrode of each of the thin film transistors T11 is alternatively connected to the first and second data lines DL11 and DL12, the gate electrode of each of the thin film transistors is connected to the gate lines GL11~GL1*n*, and the drain electrode is connected to the pixel electrode 111 inside the pixel P11.

In the pixels P11 in a line unit, one of two gate lines GL11~GL1*n* for defining a pixel region is defined as the $n^{th}$ gate line and another is defined as the $n^{th+1}$ gate line, in which the N denotes the natural number. As illustrated in FIG. 3, in the pixels P11 in a line unit, the gate electrode of the thin film transistor T11 provided at each pixel is sequentially alternately connected to the $n^{th}$ gate line and the $n+1^{th}$ gate line.

The first data lines DL11 of the plurality of data lines for dividing the pixel P11 in a vertical direction indicate the odd numbered data lines DL11, and the second data lines DL 12 indicate the even numbered data lines DL12. Also, the first common voltage lines CL11 and the second common voltage lines CL12 arranged on the substrate in a horizontal direction respectively indicate the odd numbered and the even numbered common voltage lines.

The first and second common voltage lines CL11 and CL12 are arranged parallel with the gate lines GL11~GL1*n* with a certain interval. The first common voltage lines CL11 are electrically connected to one another, and the second common voltage lines CL12 are electrically connected to one another. A high potential voltage and a low potential voltage are alternately applied to the first common voltage lines CL11 and the second common voltage lines CL12 during each frame. That is, the first common voltage line CL11 applies the first common voltage of a pulse shape transmitted during each frame to the common electrode 113A of the pixel P11, and the second common voltage line CL12 applies a first common voltage of a pulse shape that is inverted to the common electrode 113B of the pixel P11.

In the LCD device, when a scan signal is sequentially applied to the gate lines GL1~GLn from a gate driving unit (not shown), the thin film transistors T11 at the corresponding gate line are turned on. At this time, a conduction channel is formed between the source electrode and the drain electrode of the turned-on thin film transistor T11, and image data supplied to the source electrode of the thin film transistor T11 through the first and second data lines DL11 and DL12 is supplied to the drain electrode of the thin film transistor. Since the drain electrode is connected to the pixel electrode 111, the image data is supplied to the pixel electrode 111. The image data is applied to adjacent pixels P11 by a dot inversion method in order that adjacent pixels P11 have different polarities.

A common voltage is supplied to the common electrode 113 formed in the pixel P11 from the first and second common voltage lines CL11 and CL12.

Image data having an inverted pulse shape is applied to adjacent pixels using a dot inversion method. By applying two voltages having pulse shapes opposite to each other to the first and second common voltage lines CL11 and CL12, respectively, the image data supplied to the thin film transistors T11 connected to the $N^{th}$ gate line have the same polarity and the image data supplied to the thin film transistors T11 connected to the $n+1^{th}$ gate line have the same polarity. Accordingly, image data having the same polarity is supplied to the pixels P11 in a line unit divided by the $N^{th}$ gate line and the $n+1^{th}$ gate line. The common voltage having an opposite polarity to the image data applied to the pixel P11 is applied to the common electrodes 113A and 113B inside each pixel P11 through the first and second common voltage lines CL11 and CL12 in a line unit.

The common voltage is inverted at the first and second common voltage lines CL11 and CL12, and image data is applied to a liquid crystal display panel by a dot inversion method thereby increasing the voltage difference between the pixel electrode 111 and the common electrodes 113A and 113B in the pixel P11. Therefore, even if image data having a voltage less than that of the related art is applied to the pixel, the same voltage difference as that of the related art can be obtained, thereby reducing the power consumption of the LCD device.

Figure 4:
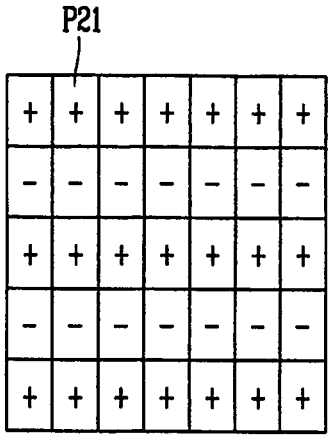
FIG. 4 is a view illustrating the polarity of image data realized in a pixel of the LCD device of FIG. 3.

FIG. 4 is a view illustrating the polarity of the image data realized in a pixel of the LCD device of FIG. 3. As illustrated, the pixel P21 is realized in the liquid crystal display panel as a line unit with the same polarity, and the polarity is changed at each line. That is, image data is applied to the liquid crystal display panel by a dot inversion method, but the image data is realized on the liquid crystal display panel by a line inversion method.

Since image data in each line has the same polarity, the voltage difference between the image data and the common voltage can be maximized at each pixel by inverting the common voltage. However, each line where the pixel exists has a strong polarity thereby causing a constant voltage level change at the first or second common voltage line CL11, CL12 electrically connected to each pixel P21.

Figure 5A:
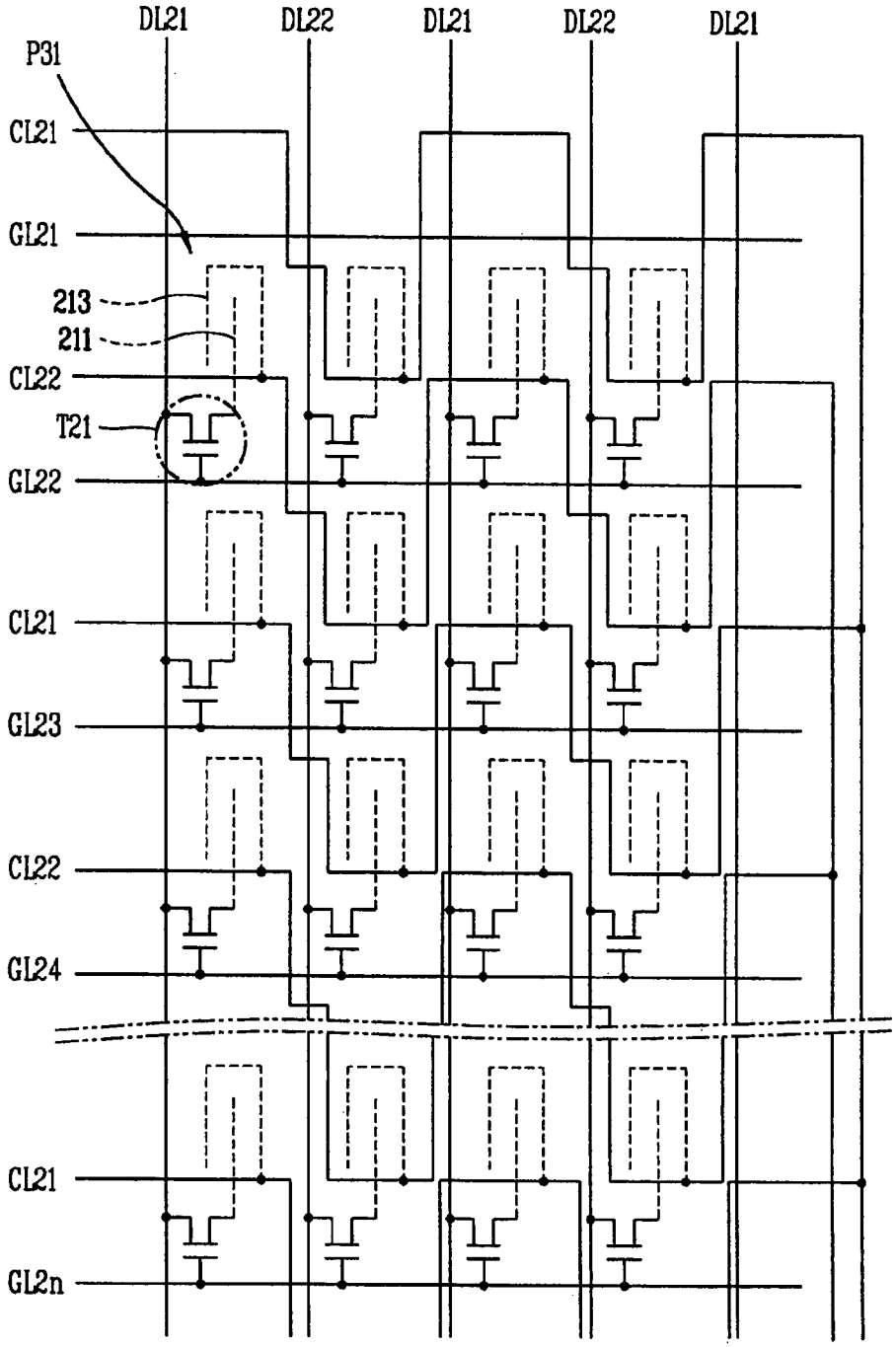
FIG. 5A is a view illustrating an LCD device according to a second embodiment of the invention.
Figure 5B:
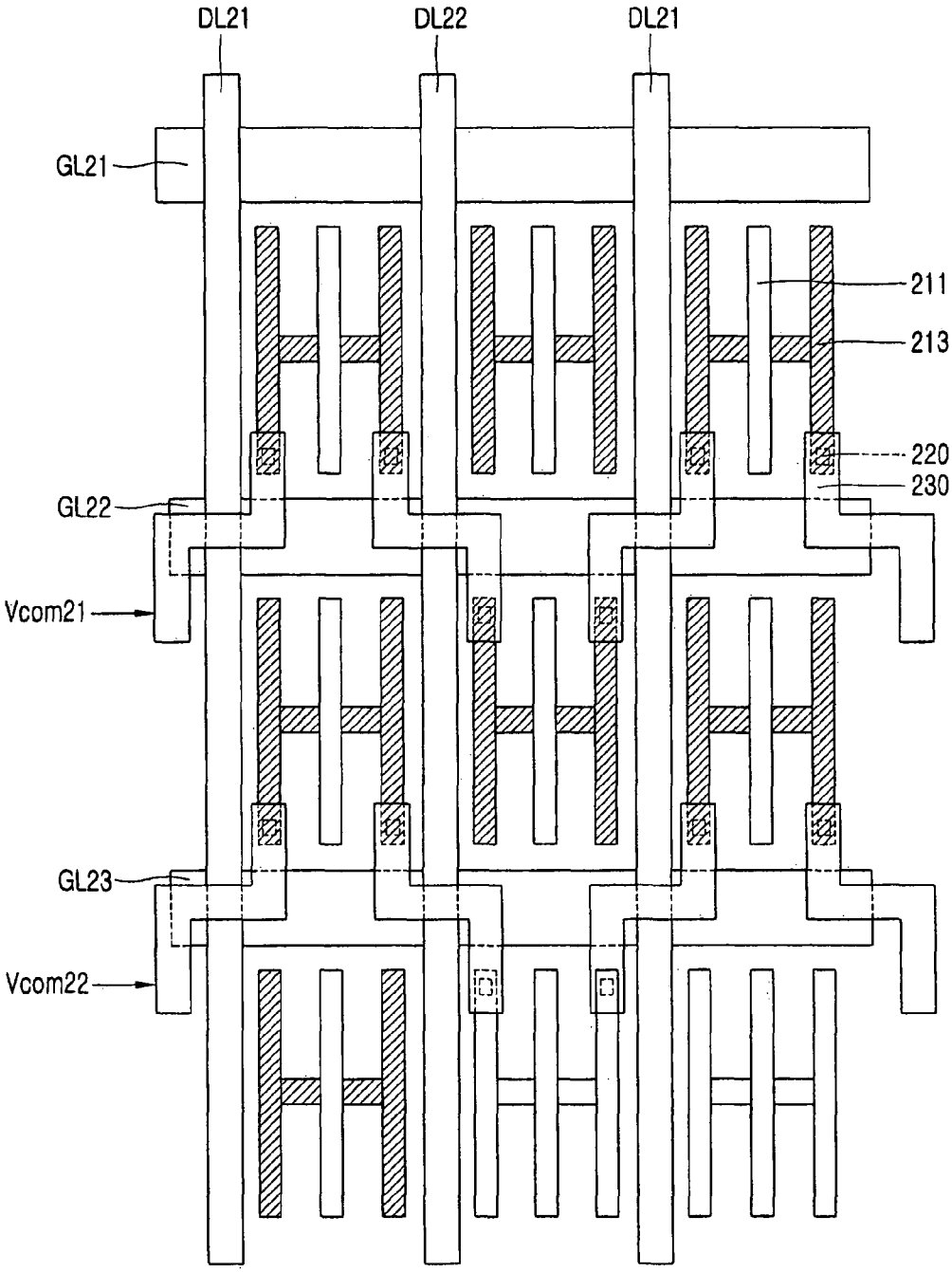
FIG. 5B is an exemplary view illustrating the arrangement of the common electrode according to the embodiment of the invention illustrated in FIG. 5A.

FIG. 5A is a view illustrating an LCD device according to a second embodiment of the present invention, and FIG. 5B is an exemplary view illustrating the arrangement of the common electrode according to a second embodiment of the invention.

Referring to FIGS. 5A and 5B, the LCD device comprises: a plurality of first and second data lines DL21 and DL22 alternately arranged on a substrate in a vertical direction; a plurality of gate lines GL21~GL2*n* arranged on the substrate in a horizontal direction; a plurality of pixels P31 formed at each intersection between the gate lines GL21~GL2*n* and the first and second data lines DL21 and DL22, and arranged on the substrate in a matrix form; a pixel electrode 211 and a common electrode 213 respectively provided at the pixel P31 and forming a horizontal electric field; and first and second common voltage lines CL21 and CL22 arranged on the substrate in a horizontal direction such that they alternate with the gate lines GL21~GL2*n*.

Each pixel P31 is provided with a switching device, for example, thin film transistor T21. The source electrode of each of the thin film transistors T21 is alternately, electrically connected to the first and second data lines DL21 and DL22. The gate electrode of each of the thin film transistors T21 is electrically connected to a gate line GL21~GL2*n*, and the drain electrode is electrically connected to the pixel electrode 211. Differently from FIG. 3, the plurality of thin film transistors T21 connected to the pixel P31 in a line unit are connected to the same gate line GL21~GL2*n*.

The first and second common voltage lines CL21, CL22 are alternately connected to the common electrodes 213 of the pixels P31 in a line unit. In other words, the first common voltage line CL21 is electrically connected to the odd numbered pixels P31 of the $N^{th}$ line, and the second common voltage line CL22 is electrically connected to the even numbered pixels P31 of the $N^{th}$ line. The first common voltage lines CL21 are electrically connected to each other and the second common voltage line CL22 are electrically connected to each other.

A first common voltage with a first potential transmitted during each frame is applied to the first common voltage line CL21, and a second common voltage line having a potential opposite to the first common voltage is applied to the second common voltage line CL22. Accordingly, a voltage of an inverted pulse shape applied from the first common voltage line CL21 and the second common voltage line CL22 is applied to the pixel P31 of a line unit.

The first data lines DL21 and the second data lines DL22 respectively indicate the odd numbered data lines and the even numbered data lines. Image data having different polarities applied from the data driving unit (not shown) is applied to the first and second data lines DL21 and DL22, and the polarity of the image data is inverted for each frame.

The LCD device is driven as follows. When a scan signal is sequentially applied to the gate lines GL21~GL2*n* from a gate driving unit, the thin film transistors T21 connected to the corresponding gate lines GL21~GL2*n* are turned on, and the image data outputted from a data driving unit is applied to the source electrode of the turned-on thin film transistor T21. The image data is outputted to the drain electrode thereby being applied to the pixel electrode 211. Image data having different polarities at adjacent pixels is applied to the pixels P31 in a line unit through the first and second data lines DL21 and DL22.

The first common voltage and the second common voltage having different polarities are applied to the common electrodes 213 of the pixels P31 in a line unit through the first common voltage line CL 21 and the second common voltage line CL 22. When image data with a high potential voltage is applied to the odd numbered pixels P31 in a line unit, a common voltage with a low potential voltage is applied to the pixels P31 thereby generating a large voltage difference between the pixel electrode 211 and the common electrode 213. Also, when image data with a low potential voltage is applied to the even numbered pixels P31 in a line unit, a common voltage with a high potential voltage is applied to the pixels P31 thereby generating a large voltage difference between the pixel electrode 211 and the common electrode 213.

As aforementioned, since the common voltage and the image data are applied to adjacent pixels by a dot inversion method, a large voltage difference is generated between the pixel electrode 211 and the common electrode 213 thereby increasing the electric field applied to the liquid crystal. Therefore, when the same common voltage and image data as those of the related art are applied, a larger voltage difference can be obtained. Accordingly, even if image data having a voltage less than that of the related art is applied to the pixel electrode, the same voltage difference as that of the related art is obtained thereby decreasing the power consumption of the LCD device. Also, image data is applied to each pixel P31 arranged on the liquid crystal display panel using a dot inversion method to be realized on the liquid crystal display panel by the dot inversion method, so that the adjacent pixels P31 have different polarities thereby to prevent a horizontal cross talk.

FIG. 5B illustrates that the common electrode 213 is electrically connected to a contact portion 230. Each common electrode 213 is electrically connected to each other by a contact portion 230 formed of indium-tin-oxide (ITO), a transparent conductive material. The contact portion 230 and the common electrode 213 are electrically connected to each other by a contact hole 220. Accordingly, the first common voltage Vcom21 or the second common voltage Vcom22 is applied to adjacent pixels P31 through the contact portions 230 and contact holes 220.

Figure 6A:
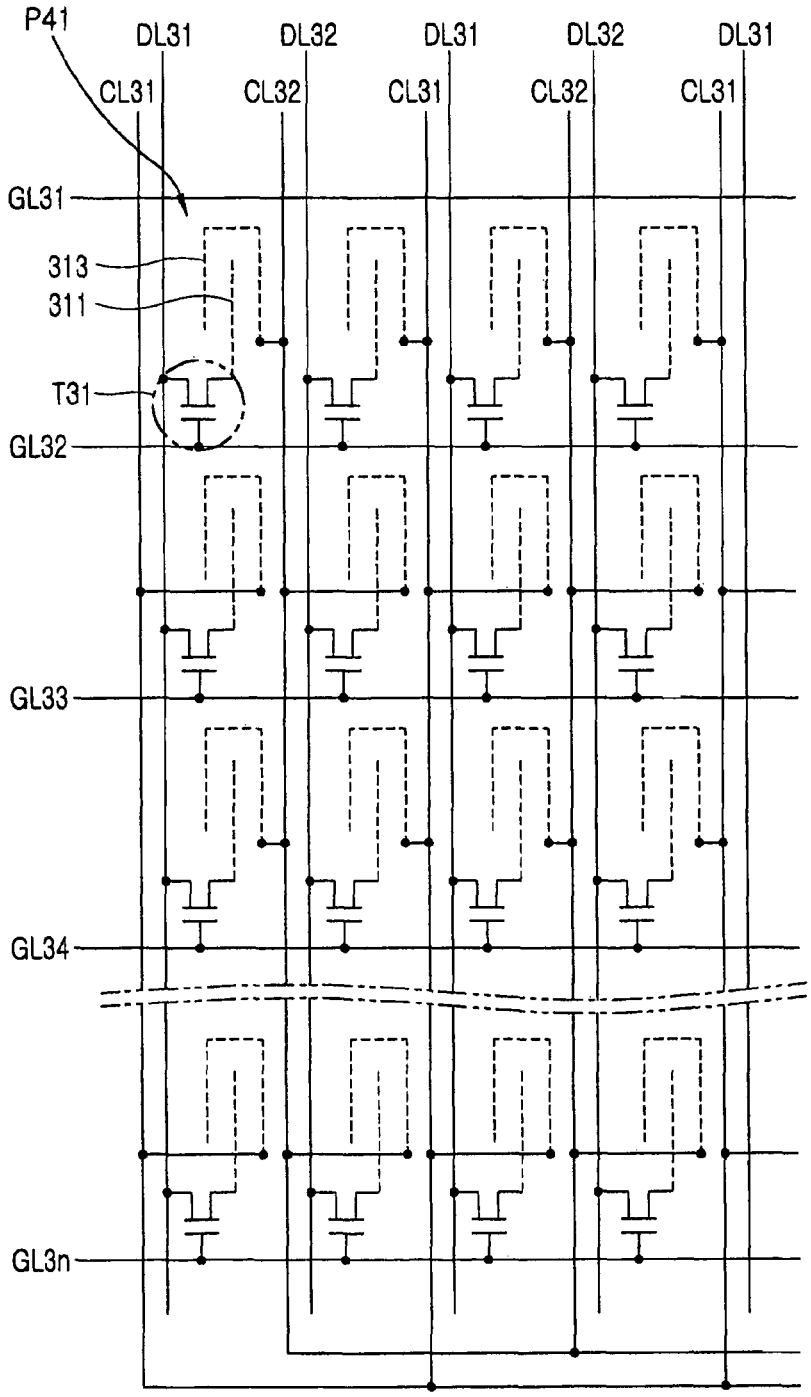
FIG. 6A is a view illustrating an LCD device according to a third embodiment of the invention.
Figure 6B:
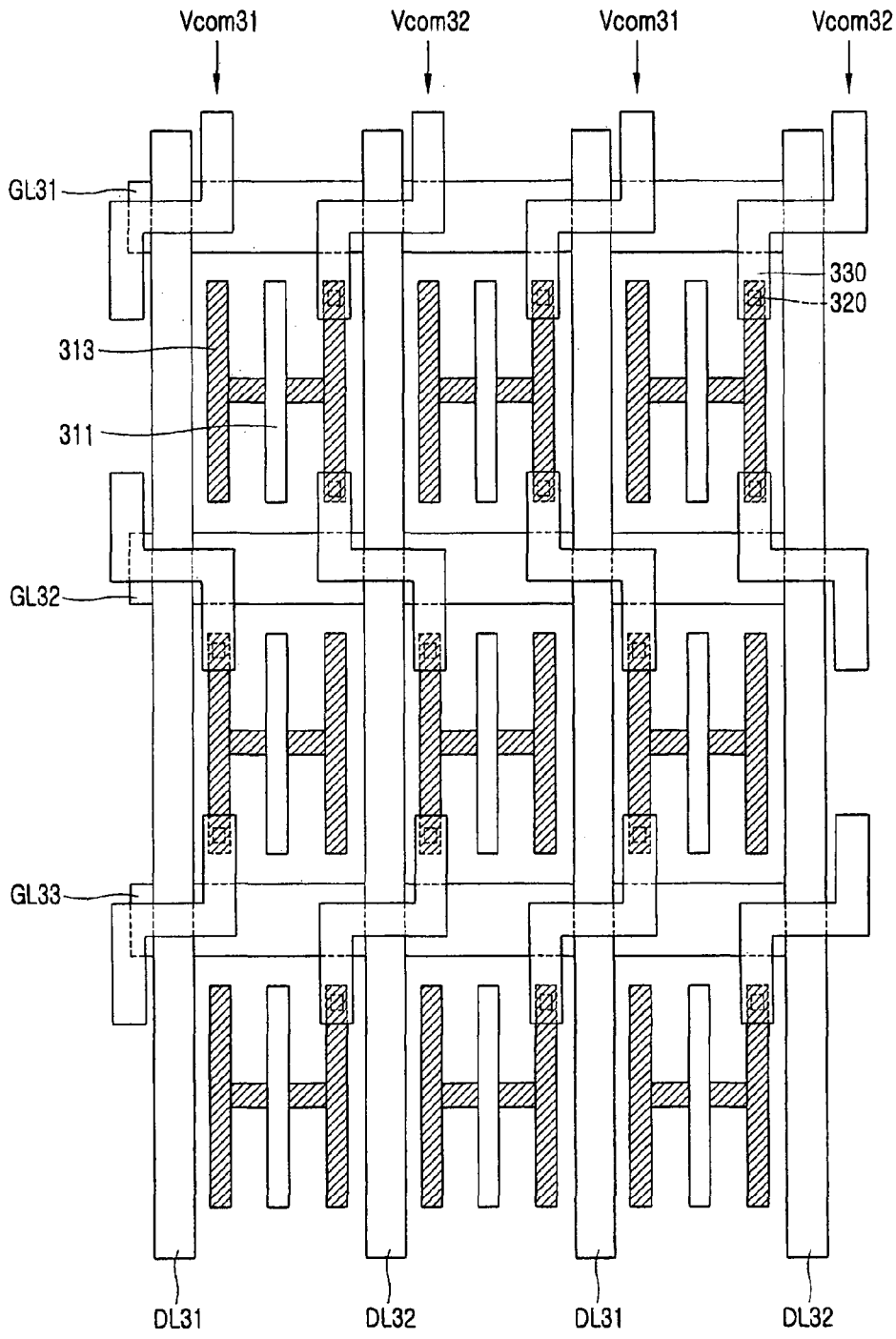
FIG. 6B is an exemplary view illustrating the arrangement of the common electrode according to the embodiment of the invention illustrated in FIG. 6A.

FIG. 6A is a view illustrating an LCD device according to a third embodiment of the present invention, and FIG. 6B is an exemplary view illustrating that the arrangement of the common electrode according to the third embodiment.

In contrast to the device illustrated in the FIG. 5A, wherein the first common voltage line CL21 and the second common voltage line CL22 were arranged on the substrate in a horizontal direction, the first and second common voltage lines CL31 and CL32 are arranged on the substrate in a vertical direction in the device illustrated in FIG. 6A. The construction of FIG. 6A is the same as that of FIG. 5A except for the arrangement of the first and second common voltage lines CL31 and CL32 and a connection state between the first and second common voltage lines and a pixel P41, thereby omitting the explanation.

Referring to FIG. 6A, the LCD device comprises: a plurality of gate lines GL31~GL3*n* arranged on a substrate in a horizontal direction; a plurality of first data lines DL31 and second data lines DL32 arranged on the substrate in a vertical direction; a plurality of first and second common voltage lines CL31 and CL32 alternately arranged on the substrate in a vertical direction; a plurality of pixels P41 formed at each intersection between the gate lines GL31~GL3*n* and the data lines DL31 and DL32; and a pixel electrode 311 and a common electrode 313 provided in the pixel P41 and forming a horizontal electric field.

The first common voltage lines CL31 and the second common voltage lines CL32 arranged on the substrate in a vertical direction are respectively electrically connected to one another. In other words, the even numbered common voltage lines are connected to each and the odd numbered common voltage lines are connected to each other.

The pixel P41 is arranged on the substrate in a matrix configuration, and the common electrodes 313 provided at the pixels P41 in a column unit are alternately connected to the first common voltage line CL 31 and the second common voltage line CL32. That is, the common electrodes 313 of the odd numbered pixels P41 in a column unit are electrically connected to the first common voltage line CL31, and the common electrodes 313 of the even numbered pixels P41 in the column unit are electrically connected to the second common voltage line CL32. Alternatively, the common electrodes 313 of the even numbered pixels P41 in a column unit may be electrically connected to the first common voltage line CL31, and the common electrodes 313 of the odd numbered pixels P41 in the column unit may be electrically connected to the second common voltage line CL32. Whereas the first and second common voltage lines CL21 and CL22 are alternately connected to the pixels P31 in a line unit in FIG. 5A, the first and second common voltage lines CL31 and CL32 are alternately connected to the pixels P41 in a column unit in FIG. 6A.

Although the construction of the device illustrated in FIG. 5A is different from the device illustrated in FIG. 6A, the operation of the LCD devices of FIGS. 5A and 6A is the same.

When a scan signal is sequentially applied to the gate lines GL31~GL3*n* from a gate driving unit, the thin film transistors T31 connected to corresponding gate lines GL31~GL3*n* are turned on, and image data is applied to the pixels P41 through the turned-on thin film transistors T31. Image data having different polarities at adjacent pixels is applied to each pixel P41 using a dot inversion method through the first and second data lines DL31 and DL32.

A first common voltage and a second common voltage having different potentials is alternately applied to the common electrodes 313 of the pixels P41 in a column unit using the first and second common voltage lines CL31 and CL32 arranged on the substrate in a vertical direction. Accordingly, the image data and the common voltage have a large voltage difference due to the different potential at each pixel P41.

Image data is applied to each pixel P41 arranged on the substrate using a dot inversion method through the first and second data lines DL31 and DL32 to realize the polarity of each pixel P41 on the screen, thereby preventing a cross talk in the pixels P41 of the same line or the same column. Referring to FIG. 6A, each common electrode 313 is connected to another by a contact portion 330 formed of indium-tin-oxide (ITO). The contact portion 330 is electrically connected to the common electrode 313 by a contact hole 320. The construction of FIG. 6A is different from that of FIG. 5B in that each contact portion 330 is arranged on the substrate in a vertical direction to be alternately positioned at right and left sides of the first and second data lines DL31 and DL32 in a zigzag form.

As aforementioned, a voltage difference is larger in the LCD device of the present invention than in the LCD device of the related art. Therefore, even if a voltage less than that of the related art is applied to liquid crystal, the pixels can be equally driven like in the LCD device of the related art, thereby minimizing consumption power.

Also, the screen is realized by a dot inversion method that image data has different polarities at adjacent pixels thereby preventing deteriorated picture quality such as cross talk.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display (LCD) device comprising:

a plurality of data lines arranged in a column direction on a substrate;

a plurality of gate lines arranged in a row direction on the substrate;

a plurality of pixels formed at intersections between the gate lines and the data lines, which are perpendicular to each other and arranged on the substrate in a matrix configuration;

a plurality of first electrodes and a plurality of second electrodes at each pixel, respectively, for generating an electric field between the first electrodes and the second electrodes; and a plurality of first common voltage lines alternately arranged with a plurality of second common voltage lines on the substrate in the row direction, wherein each of the plurality of first common voltage lines are connected to second electrodes at a plurality of pixels of odd numbered rows and odd numbered columns and connected to second electrodes at a plurality of pixels of even numbered rows and even numbered columns adjacent to the odd numbered rows and odd numbered columns, wherein each of the plurality of second common voltage lines are connected to second electrodes at a plurality of pixels of even numbered rows and even numbered columns and connected to second electrodes at a plurality of pixels of odd numbered rows and odd numbered columns, so that each of the second electrodes in two pixels adjacent in the row or the column direction are respectively connected to the first common voltage line and the second common voltage line, wherein a voltage polarity applied to the first common voltage lines is different than a voltage applied to the second common voltage lines.

2. The LCD device of claim 1, wherein the first electrodes are pixel electrodes and the second electrodes are common electrodes.

3. The LCD device of claim 1, wherein the first common voltage lines are electrically connected to each other and the second common voltage lines are electrically connected to each other.

4. The LCD device of claim 1, wherein the first common voltage lines and the second common voltage lines are formed on the substrate in a horizontal direction.

5. The LCD device of claim 1, wherein a first common voltage having a pulse shape transformed on a one frame basis is applied to the first common voltage lines, and a second common voltage having a pulse shape that is an inversion of the first common voltage is applied to the second common voltage lines.

6. The LCD device of claim 1, wherein the second electrodes of even numbered pixels in a line unit are connected to the first common voltage lines, and the second electrodes of odd numbered pixels in the line unit are connected to the second common voltage lines.

* * * * *